US005212340A

United States Patent [19]

Hardt et al.

[11] Patent Number: 5,212,340

[45] Date of Patent: May 18, 1993

[54] SAFE AND ARM DEVICE USING LIQUID EXPLOSIVE

[75] Inventors: Lee R. Hardt; Donald R. Burnett, both of Ridgecrest, Calif.

[73] Assignee: The United States of America as represented by the Secretary of the Navy, Washington, D.C.

[21] Appl. No.: 591,209

[22] Filed: Oct. 1, 1990

[51] Int. Cl.[5] ..... F42C 15/32

[52] U.S. Cl. ..... 102/223; 102/228; 102/277.1

[58] Field of Search ..... 102/223, 228, 222, 277.1

[56] References Cited

U.S. PATENT DOCUMENTS

| | | | |
|---|---|---|---|
| 970,122 | 2/1910 | Schmidt et al. | 200/81.6 |
| 1,321,407 | 11/1919 | Taylor | 102/222 |
| 1,685,211 | 8/1927 | Beck | 200/81.6 |
| 3,002,456 | 1/1956 | Savitt | 102/222 |
| 3,065,694 | 12/1955 | Plank | 102/222 |
| 3,079,047 | 1/1960 | Chiodini | 222/82 |
| 3,602,141 | 8/1971 | Sutter | 102/305 |
| 3,722,407 | 3/1973 | Fogal et al. | 102/228 |
| 3,881,419 | 5/1975 | Bea | 102/222 |
| 3,938,443 | 2/1976 | Wolski | 102/228 |
| 4,058,061 | 6/1966 | Mansur et al. | 102/429 |
| 4,241,660 | 12/1980 | Donovan | 102/473 |

FOREIGN PATENT DOCUMENTS

| | | | |
|---|---|---|---|
| 502762 | 5/1920 | France | 102/223 |

*Primary Examiner*—Stephen Johnson

*Attorney, Agent, or Firm*—Stephen J. Church; Melvin J. Sliwka; John L. Forrest, Jr.

[57] ABSTRACT

A safe and arm device, which has an explosive train interrupted by a void to establish a safe condition, has the void filled with a liquid explosive to establish an armed condition. The void may be in a manometer-like device in which the liquid explosive is motivated by fluid pressure corresponding to free-fall or other velocities. The void may be a chamber portion filled with the liquid explosive by expansion of a bladder. Premature arming may be prevented by forming the explosive liquid from nonexplosive liquids mixed by rupture of a bladder or by melting a solid explosive with heat generated electrically or provided from ram air or combustion.

7 Claims, 6 Drawing Sheets

SAFE AND ARM DEVICE USING LIQUID EXPLOSIVE

BACKGROUND OF THE INVENTION

1. Field of the Invention

The present invention pertains to the field of ammunition and explosives. More particularly, the invention pertains to the field of arming devices of the blocking or interrupting type which may be operated by fluid pressure or inertia.

2. Description of the Related Art

Safe and arm devices typically have an explosive train including an element which is displaced from the train to place the device in a safe condition and which is inserted into the trail to place the device in an armed condition. The element is, typically, a pellet of explosive mounted in a rotor or slide which is motivated, when conditions are appropriate for arming, to carry the pellet&. into the train. Since detonation of an explosive typically requires that it be subjected to a shock wave, as from a previously detonated explosive in an explosive train, it is known to provide a safe condition by providing a void in the train, the void being filled by some inert, but shock wave transmitting, material to establish an armed condition.

For safety, economy in construction, and reliability, it is highly desirable that insertion of an element for arming be motivated directly by an environmental condition only existing when arming is required. A typical example is the motivation of a element, such as an above-mentioned slide or rotor, by the inertia of the element when a projectile is fired from a gun. However, direct motivation of such an element may not be practical when the envirormental condition, such as mild acceleration or a relatively slight pressure change, provides relatively limited force. Although such a lack of force may be overcome by using low friction elements, by using energy stored in springs or batteries, by using electronic sensors and amplifiers, or by using very large inertia or pressure responsive elements, the resulting bulk, expense, and fragility are highly undesirable. Also, it is evident that a safe and arm device actuated by a relatively small environmental change or by stored energy is impracticably dangerous unless stringent precautions are taken to prevent premature arming when a similar change occurs during shipping, handling, or as a result of accident. Even where relatively large environmental forces are available, as from ram air in an air launched missile, safe and arm devices typically sense conditions for arming and assume an armed condition using mechanical or electromechanical devices which are relatively complex and, therefore, are expensive and unreliable and require further complexities to prevent improper arming.

It is known in an underwater ordnance device such as a mine to have an explosive train interrupted by a void and to arm the device by filling the void with water for transmission of a detonation shock wave, the filling typically occurring by gravity when water soluble plugs on the device exterior dissolve subsequent to placement of the device in its intended environment. In such underwater devices, it is apparent that large explosive train elements may be provided to generate a shock wave effective to initiate further detonation despite attenuation by the water, that a substantial length of time is available for dissolving the plugs and filling the void, and that this delay and the use of plugs soluble only in the intended environment provide stringent safety precautions. It is also apparent that such an arrangement using an inert liquid, while practical for underwater ordnance, is impractical in a safe and arm device for use, for example in an air launched missile, where bulk and weight must be minimized and arming must occur in a fraction of a second, or where, as in free-fall ordnance, there is no environmental condition change as substantial and enduring as that from air to undersea emplacement.

SUMMARY OF THE INVENTION

A safe and arm device, which has an explosive train interrupted by a void to establish a safe condition, has the void filled with a liquid explosive to establish an armed condition. The void may be in a manometer-like device wherein the liquid is motivated to move into the void by fluid pressure which may correspond to a predetermined aerial velocity ranging from free-fall to supersonic. Where gravity or an inertia force are not available or do not act in a predetermined direction, the void may be a region of a chamber to which the liquid explosive is transferred by expansion of a bladder or the like in the chamber. The bladder may be inflated by such air or other fluid pressure. Premature arming may be prevented by use of an explosive liquid formed on mixing of nonexplosive liquids, as by rupture of such a bladder containing one of the liquids, or by melting a solid explosive, the melting being by heat generated electrically or pyrotechnically or derived from ram air or from a rocket motor or other propulsion system. An arming delay may be provided by an orifice or by a viscosity determining the flow of the explosive liquid, and this delay may be altered by varying the orifice or varying the temperature of the liquid explosive to change its viscosity.

OBJECTS OF THE PRESENT INVENTION

An object of the present invention is &o provide a safe and arm device which may be motivated to an armed condition directly and reliably by relatively slight changes in environmental conditions and which reliably remains in a safe condition until other conditions for arming are satisfied.

Still another object is to provide such a device which may be prevented from establishing its armed condition by any one or more of variety of predetermined conditions involving pressure, inertia, or temperature.

Another object is to provide a safe and arm device which has the above advantages and yet is simple, inexpensive, rugged, and compact.

BRIEF DESCRIPTION OF THE DRAWINGS

Other objects, advantages, and novel features of the present invention will become apparent from the following detailed description when considered with the accompanying drawings in which.

DETAILED DESCRIPTIONS

In the following descriptions, it is to be understood that the described embodiments of the present invention are only portions of safe and arm devices which may have a variety of constructions providing electrical, electronic, mechanical, and/or chemical safe and arm arrangements in addition to those of the present invention and that these additional arrangements and those of the present invention may be used in many operating environments including, by way of example only, air or surface launched missiles, bombs, projectiles, and mines with arming and final actuation by a variety of presently well-known or later developed devices adapted to the particular environment. Therefore, the following descriptions and accompanying drawings depict embodiments of the present invention and associated elements of representative operating environments diagrammatically with the scales, relative positions, and details of the depicted elements selected to show the present invention and without mounting and connecting elements which may vary with the particular operating environment and which may of any suitable construction selected by one skilled in the art of ammunition and explosives.

First Embodiment

Figure 1:
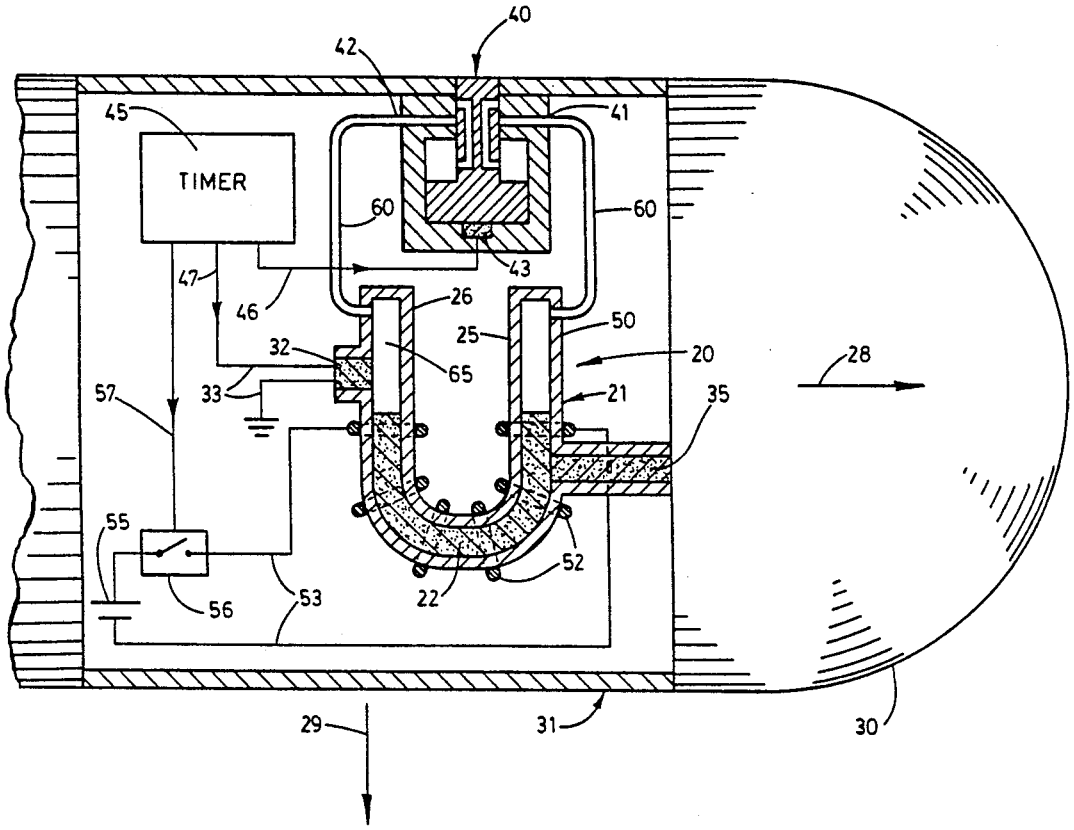
FIG. 1 is a diagram of a first safe and arm device which embodies the present invention and is characterized by having a manometer, this device being shown in a safe condition and in a first representative operating environment.

FIG. 1 shows a safe and arm device 20 which is a first embodiment of the present invention characterized by having a manometer 21 containing a predetermined quantity of an explosive 22. Device 20 is depicted in a representative operating environment of a portion of a missile or the like vehicle. Manometer 21 is a U-tube manometer having opposite arms 25 and 26 subjected to a diiferential air pressure. However, "manometer" is used in the present application in the general sense of a device having a tube or other enclosure wherein a liquid is displaced by fluid pressure, the displacement being proportional to the density of the liquid and to an acceleration, as from gravity, centrifugal force, or a propulsion system, to which the manometer is subjected. The FIG. 1 missile is adapted to move in air in the direction indicated by arrow 28 while gravity or a comparable centrifugal force acts in the direction indicated by arrow 29.

The FIG. 1 missile portion has a warhead section 30 having an explosive charge, not specifically shown, to be exploded at an appropriate time by a fuze section 31 which includes device 20 and a detonator 32 juxtapositioned to manometer arm 25 and initiated electrically through electrical leads 33 to provide a detonation or shock wave to device 20 for transmission or blocking by the device. A transmitted such wave is provided to warhead 31 from manometer arm 26 through an explosive lead 35 so that manometer 21, detonator 32, and lead 35 are an explosive train. Explosive 22, lead 35, and the charge of warhead section 30 are each composed of a substance which will not explode, that is decompose violently in a detonation wave, unless initiated by another detonation wave which has not been attenuated by passage through a "void", which for purposes of the present application may be the atmosphere or other fluid.

Explosive 22 may be a liquid under all normal conditions, but is preferably any suitable substance having a solid state which can be liquified, as by solvents or heating, to provide an explosive liquid. In particular, explosive 22 may be a substance having a phase which is solid at ambient temperatures and which melts at a predetermined temperature to a liquid phase by the application of heat. It is believed that trinitrotoluene (TNT) which melts at about 80° C. (176° F.), is such a substance well suited for the practice of the present invention.

Fuze section 31 includes a well-known, extensible probe 40 which is depicted in a retracted condition in FIG. 1. Probe 40 has connections 41 and 42 providing a differential pressure corresponding to missile velocity in direction 28. Probe 40 is motivated to an extended position depicted in FIG. 2 by a squib 43. Fuze section 30 includes any suitable timer 45 controlling a representative sequence of events, which bring the missile from an initial safe condition through an armed condition to detonation of warhead 30 and which include's firing squib 43 by a connection 46 and may include initiating detonator 32 by a connection 47. A detonator corresponding to detonator 32 may, of course, be initiated by target impact or proximity or for other reason than elapsed time not relevant to the subject invention.

Manometer 20 with its arms 25 and 26 has a tubular wall 50 which is constructed of any suitable heat conducting material and which is wound exteriorly with an electrical heating element 52 for the quantity of explosive 22. Element 52 is connected through conductors 53 to an electrical energy source 55 and is selectively energizable therefrom, as by a switch 56 controlled by a connection 57 from timer 45, to heat explosive 22 in its solid phase and provide an explosive liquid by melting.

Figure 2:
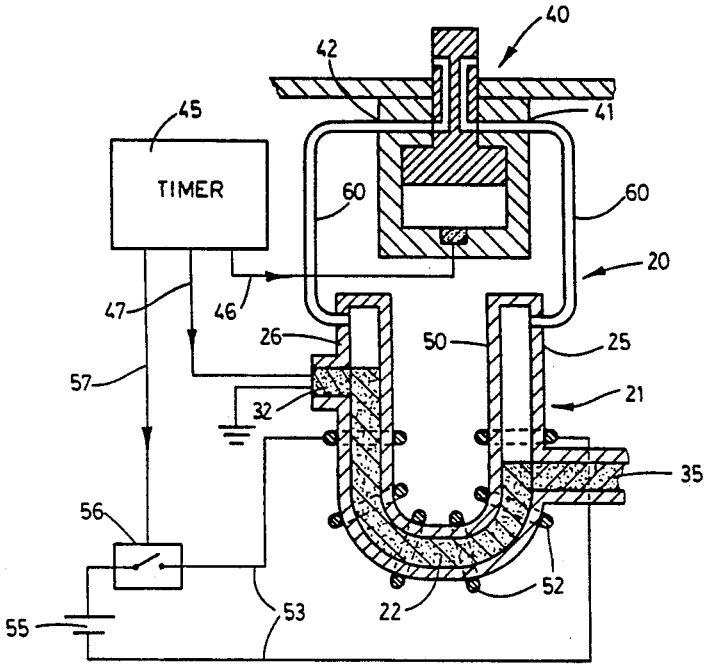
FIG. 2 is a diagram showing the device of FIG. 1 in an armed condition.

Arms 25 and 26 are connected to probe connections 41 and 42 by any suitable conduits 60 so that the differential pressure or pressurized fluid due to a predetermined velocity in direction 28 urges movement of a liquid within wall 50 in opposition to force 29 from a safe position, which is that of explosive 22 depicted in FIG. 1, to an armed position which is that of explosive 22 depicted in FIG. 2 wherein certain elements of the operating environment are omitted for simplicity. Such movement is upwardly in arm 25 and downwardly in arm 26 from the safe position wherein the surfaces 62 of the explosive are at the same level in arms 25 and 26. The quantity of explosive 22 and the respective positions of detonator 32 and lead 35 along arms 25 and 26 are selected so that detonator 32 is disposed along arm 25 at a location thereon which, in the safe condition, is above surface 62 in arm 25 and which, in the armed condition, is below this surface and are selected so that lead 35 communicates with arm 26 at a location which is below surface 62 in arm 26 in both the safe and the armed conditions. It is apparent that tubular wall 50 of manometer 20 defines an enclosure for storing the quantity of explosive 22 in its solid state with the explosive substantially occupying the region in which it is depicted in FIG. 1. It is also apparent that, with explosive 22 in its FIG. 1 safe condition, wall 50 defines within itself a predetermined void region indicated by numeral 65 and disposed where detonator 32 adjoins wall 50. It is evident that region 65 is interposed in the explosive train formed by detonator 32, manometer 20, and explosive lead 35 so as to block passage of a detonation wave from the detonator through the manometer to warhead section 30 and that wall 50 stores the predetermined quantity of explosive 22 at a location spaced from region 65.

At an appropriate time in the operation of a missile having fuze 30 with explosive 22 below its melting temperature and disposed outside of region 65, timer 45 energizes heater 52 which raises the temperature of explosive 22 above its melting temperature to form an explosive liquid, such as the liquid phase of an explosive such as TNT. Timer 45 also fires squib 43 to extend probe 40 and provide to manometer 20 and the liquid explosive therein the above-mentioned differential air pressure corresponding to the missile velocity. When the missile attains a predetermined velocity, which is determined by the relative length of arms 25 and 26, density of the explosive liquid, and the force acting in direction 29 and is a precondition for arming of fuze 30, the differential pressure urges the explosive liquid to be conducted by wall 50 from where explosive 22 is stored, as shown in FIG. 1, toward and into region 65 to establish the armed condition of the explosive train shown in FIG. 2. In this armed condition a detonation wave initiated by detonator 32 is propagated into the explosive liquid which then detonates, thereby amplifying and further propagating the detonation wave through manometer 20 to lead 35 and warhead 30.

It is apparent that device 20 cannot establish its armed condition until explosive 20 is melted by heating element 52. It is also apparent that a device such as manometer 21 may be constructed so that, after melting of an explosive therein, an armed condition may be established by relatively small differential pressure since movement of the explosive liquid in a conduit such as tubular wall 50 is relatively frictionless. Such an armed condition is also established reliably since the differential pressure, which itself is the environmental condition on which arming is to occur, motivates the explosive liquid directly without the interposition of mechanical or electromechanical devices which may fail by not establishing the armed condition when appropriate or may fail dangerously by premature establishment of the armed condition.

Second Embodiment

In certain applications of the subject invention it may be desirable to selectively delay establishment of an armed condition from a safe condition after other desired conditions for arming are present. Such a selective delay is provided in a second safe and arm device embodying the present invention and shown in FIG. 3. This second embodiment is similar to that of FIGS. 1 and 2 and corresponding elements in these three figures have the same numerals, FIG. 3 being similar to the simplified FIG. 2 but depicting the explosive liquid 22 in its safe condition as in FIG. 1.

Figure 3:
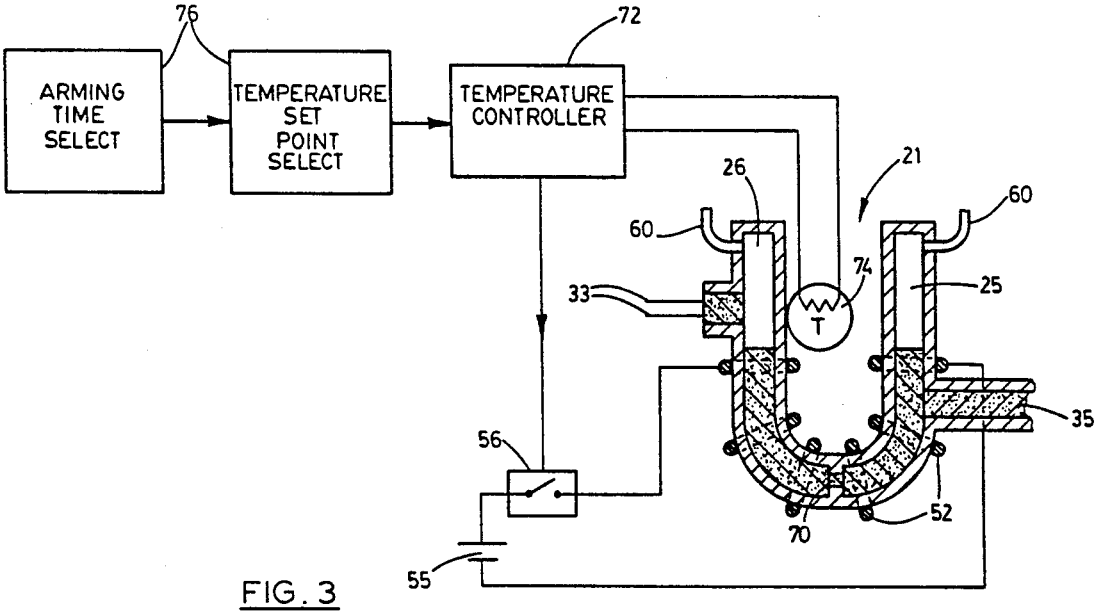
FIG. 3 is a diagram of a second safe and arm device which embodies the present invention and which is similar to the FIG. 1 device, the FIG. 3 device having a first set of additional elements for selectively delaying the armed condition.

The FIG. 3 device has an orifice 70 of a predetermined size disposed in arm 26 between surface 62 of explosive 22 and lead 35 so that the viscosity of the liquified explosive delays movement thereof into region 65 and the armed condition. The viscosity of the liquid explosive varies with temperature so that the time for this movement may be selected by selecting the liquid explosive temperature by controlling switch 56 by any suitable temperature controller 72 responsive, as through a sensor 74 at tubular wall 50 adjacent to orifice 70, to the liquid explosive temperature and responsive to a set point for this temperature provided in any suitable manner indicated by elements identified by numeral 76.

Third Embodiment

Figure 4:
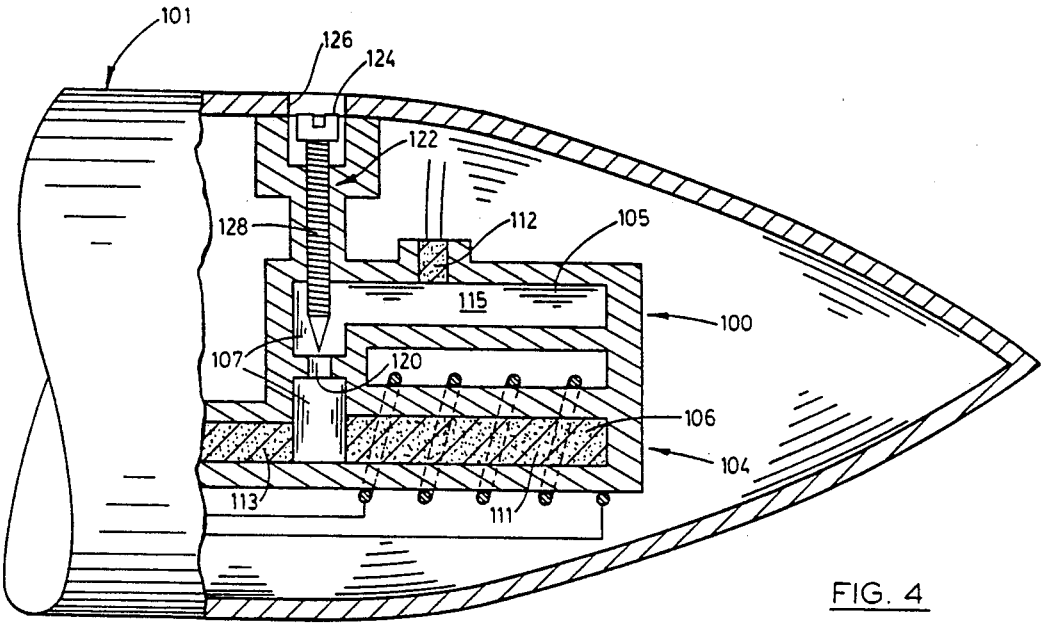
FIG. 4 is a diagram of a third safe and arm device which embodies the present invention, which is similar to the FIG. 1 device, and which is additionally characterized by arming on acceleration, the FIG. 4 device having a second set of additional elements for selectively delaying the armed condition and being shown in a safe condition and in a second representative operating environment.
Figure 5:
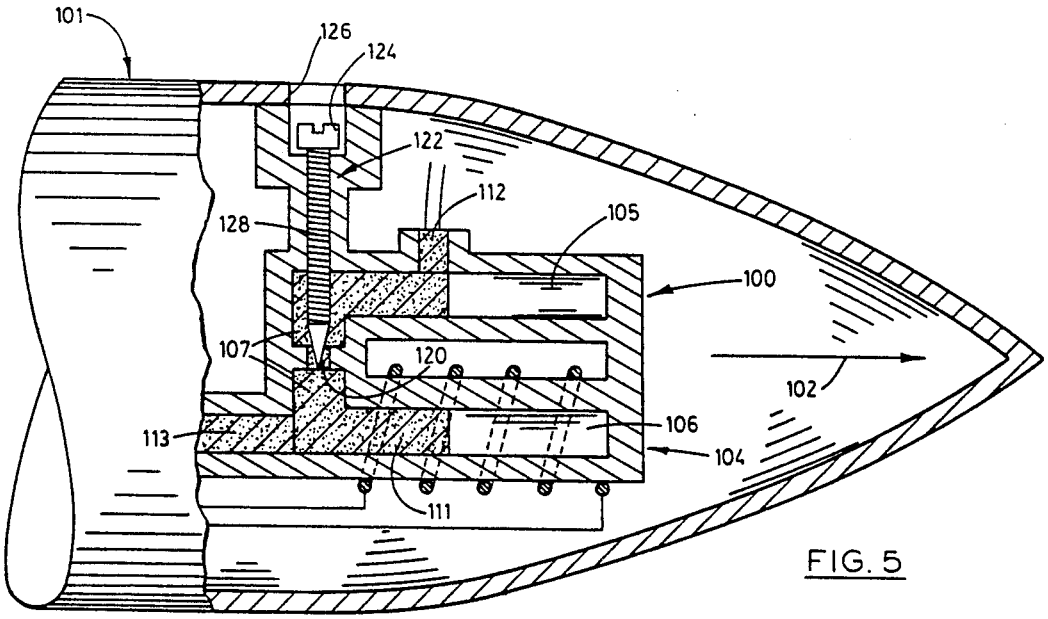
FIG. 5 is a diagram showing the device of FIG. 4 in an armed condition.

Such a selective delay in establishing an armed condition from a safe condition is also provided by a third safe and arm device 100 embodying the present invention and shown in FIGS. 4 and 5 in a representative operating environment, such as a projectile portion 101 having an acceleration in a direction indicated by numeral 102 in FIG. 5. Device 100 has a manometer body 104 with a pair of parallel passages 105 and 106 corresponding generally to FIG. 1 arms 25 and 26. These passages extend in the direction of acceleration 28 and are joined at their ends opposite the direction of acceleration by a connecting passage 107. Body 104 is provided with a heater 108 corresponding to heater 52 for liquefying a quantity of explosive 111 corresponding to explosive 22 and stored in a solid state in arm 106. A detonator 112, which corresponds to detonator 32, is disposed at arm 105 and an explosive lead 113, which corresponds to lead 35, extends from passage 106 to an explosive charge, not shown. Explosive 111 is stored in passage 106 as shown in FIG. 4 so that a void 115, corresponding to void 65, exists in passage 105 at detonator 112 and blocks transmission of a detonation wave from the detonator to lead 113 and establishes a safe condition of device 100. However, when explosive 111 is melted by heater 108 and acceleration is occurring in direction 102, the inertia of the explosive liquid urges the liquid toward void 115 to occupy the same length of both passages 105 and 106 for transmission of a detonation wave from detonator 112 to lead 113, thereby establishing an armed condition of device 100.

Device 100 has an orifice 120 disposed in passage 107 through which liquified explosive 111 flows from passage 106 toward void 115 and has a needle valve element 122 extending through body 104 into the orifice and moveable therein to vary the effective size of the orifice and select a predetermined time delay for conduction of liquified explosive from passage 106. Element 122 may be actuated in any suitable manner, as by providing the element with a head 124 disposed for rotational engagement through an opening 126 in projectile 101 and with screwthreads 128 engaging body 104.

It is apparent that device 102 cannot establish its armed condition until explosive 11 is melted by heating element 108 and that manometer body 104 may be constructed so that, after melting of the explosive, the armed condition may be established by a relatively small acceleration in direction 102. It is also apparent that a device similar to device 100 may be constructed so as to arm on relatively slight deceleration as occurs at release of a unpowered bomb.

Fourth Embodiment

Figure 6:
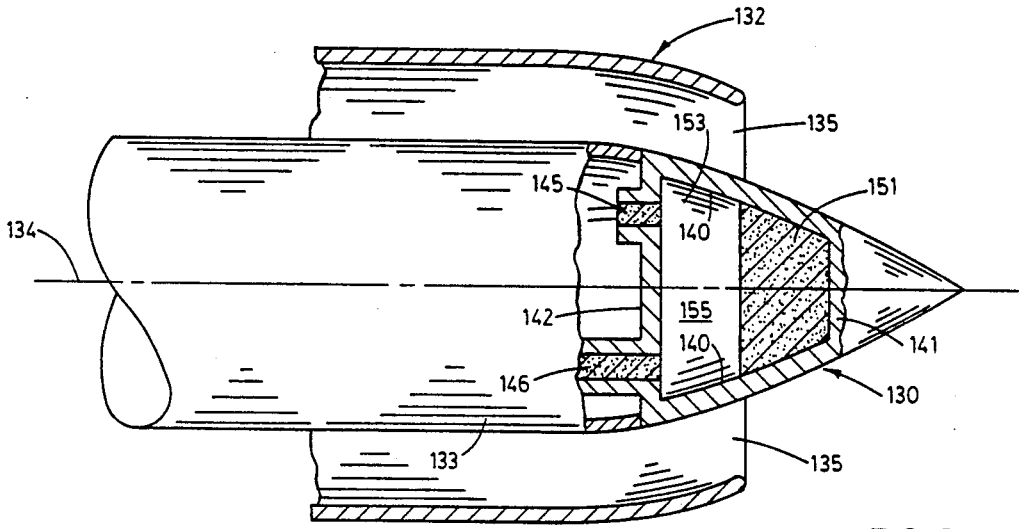
FIG. 6 is a diagram of a fourth safe and arm device which embodies the present invention and which is characterized by using ram air heating and by arming by centrifugal force, the FIG. 6 device being shown in a safe condition in a second representative operating environment.
Figure 7:
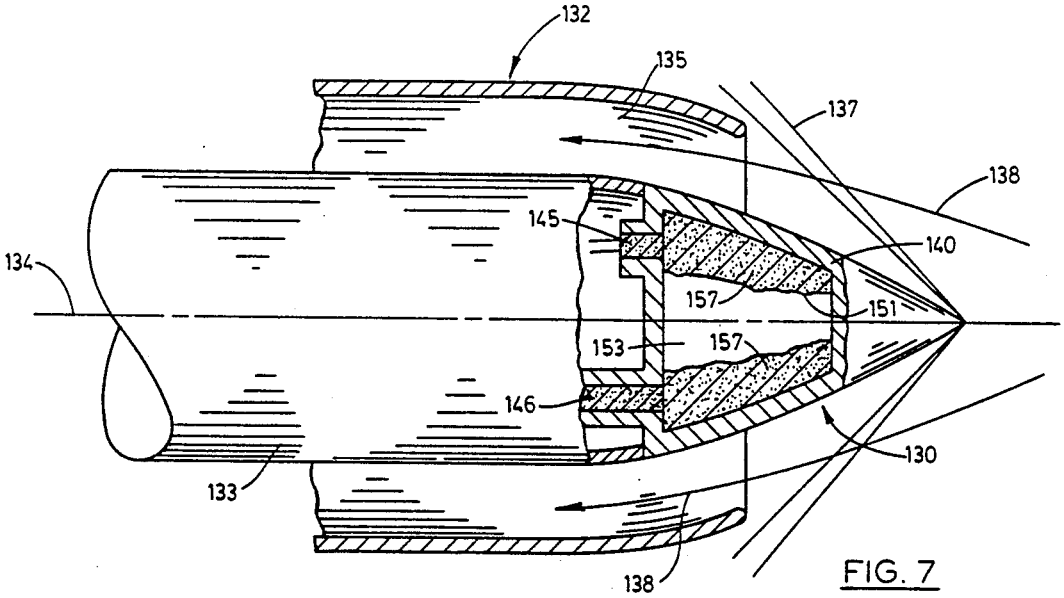
FIG. 7 is a diagram showing the FIG. 6 device in an armed condition.

A fourth safe and arm device 130 embodying the present invention is shown in FIGS. 6 and 7 in a representative operating environment which is a portion of a conventional ramjet 132 having an inner, generally cylindrical, and forwardly spike-shaped body 133 which has an axis 134 and is circumscribed by an annular duct 135. When the ramjet is in operation as shown in FIG. 7, it rotates about axis 134 and duct 135 receives ram air due to the forward velocity of the ramjet, this velocity being such that a shock wave 137 forms forwardly of the duct and ram air 138 flowing into the duct is heated at the shock wave.

Device 130 has an outer, heat conducting wall 140 disposed in the forward portion of body 133 for engagement by the heated ram air 138 so that wall 140 is heated by this air. Wall 140 is closed forwardly by a wall 141 and is closed rearwardly by a wall 142 through which extends, at locations adjacent to wall 140, a detonator 145 and an explosive lead 146 corresponding respectively to detonator 32 and lead 35 of FIG. 1. A quantity of explosive 151 corresponding to explosive 22 is stored, as shown in FIG. 6, in a solid state against wall 141 in the forward portion of an enclosure 153 which is definedly walls 140–142 and which is disposed on axis 137. Enclosure 153 is thus a portion of an explosive train including detonator 145 and lead 146. The quantity of explosive 151 is such that a void 155, corresponding generally to void 65, is disposed rearwardly in the enclosure at detonator 145 at a region of the enclosure spaced from axis 137. Void 155 thus blocks transmission of a detonation wave from the detonator to lead 146 and establishes a safe condition of device 130. However and as shown in FIG. 7, when explosive 151 is melted by heat from the ram air at shock wave 139 conducted through wall 140 while ramjet 132 is rotating about its axis 134, centrifugal force urges the explosive liquid to form a layer 157 inwardly of and concentric with wall 140 and juxtapositioned to both detonator 145 and lead 146. Layer 157 thus occupies the region of enclosure 153 formerly occupied by void 155 and is disposed so as to transmit a detonation wave from detonator 145 to lead 146, thereby establishing an armed condition of device 130.

It is apparent that device 130 cannot establish its armed condition until ramjet 132 has attained a velocity providing heated ram air 138 at a temperature sufficient to melt explosive 151 while the ramjet is rotating properly about axis 134.

Fifth Embodiment

Figure 8:
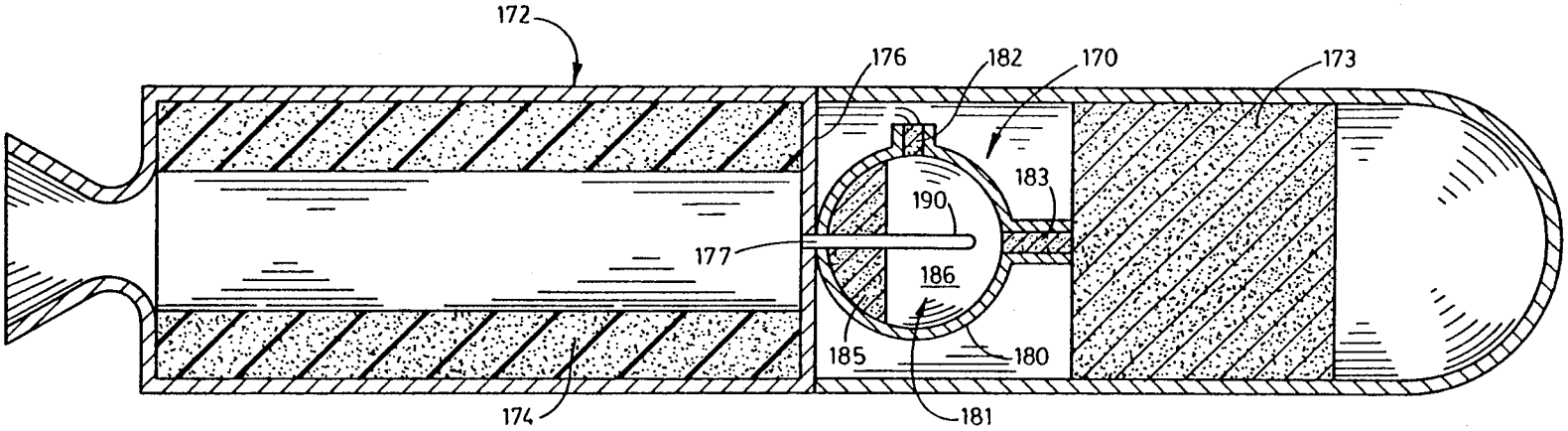
FIG. 8 is a diagram of a fifth safe and arm device which embodies the present invention and which is characterized by having an expansible element, the FIG. 8 device being shown in a safe condition and in a third representative operating environment.
Figure 9:
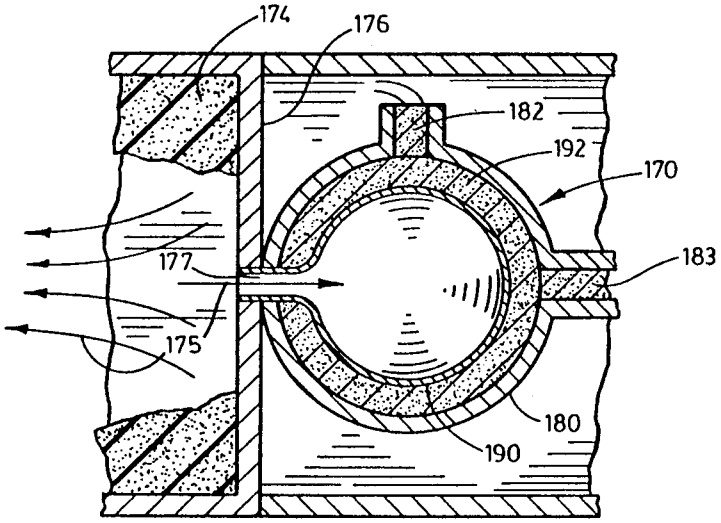
FIG. 9 is a diagram showing the FIG. 8 device in an armed condition.

A fifth safe and arm device 170 embodying the present invention is shown in FIGS. 8 and 9 in a representative operating environment which is a rocket 172 of conventional construction. As shown in FIG. 8, the rocket has a forward warhead portion including an explosive charge 173, has a central fuze portion including device 170, and has a rearward motor or propulsion portion with an exhaust nozzle and a radially centrally burning solid fuel grain 174. FIG. 9 depicts only the fuze portion and an adjacent part of the motor portion has arrows 175 indicating flow of pressurized gas from combustion of grain 174. The motor portion terminates forwardly in a wall 176 adapted to conduct heat from the combustion of grain 174 and this wall has a central orifice 177 for communication of the gas pressure from such combustion so that, for the purposes of the present invention, the motor portion is a heat generating power system and may be considered as a heat and fluid pressure generating pyrotechnic device.

Device 170 has a generally spherical heat conducting wall 180 which engages wall 177 in heat conducting relation and which defines an enclosure 181 in fluid pressure communication through orifice 177 with the motor portion of rocket 172. A detonator 182, which corresponds to FIG. 1 detonator 32, is disposed at one side of enclosure 181, and an explosive lead 183, which corresponds to lead 35, extends forwardly from enclosure 181 to charge 173 so that the enclosure is a portion of an explosive train including detonator 182 and lead 183. A quantity of explosive 185, corresponding to explosive 22, is stored, as shown in FIG. 8, in a solid state within wall 180 and in the rearward region of enclosure 181 toward wall 177. The balance of the enclosure is thus a void 186 which blocks transmission of a detonation wave from detonator 182 to lead 183 and establishes a safe condition of device 170. However when grain 174 burns, explosive 185 is melted by combustion heat transmitted through walls 176 and 180 and the resulting explosive liquid is able to flow into a region of enclosure 181 extending between the detonator and the lead thereby establishing an armed condition of device 170 shown in FIG. 9.

Device 170 has a bladder-like expansible element 190 disposed within enclosure 181 and pressurizable interiorly, through orifice 177 by fluid pressure from combustion of grain 174. Due to such pressure, element 190 expands from a contracted condition thereof, in which the element is depicted in FIG. 8, into an expanded condition of the element depicted in FIG. 9. In the contracted condition, element 190 is disposed centrally of enclosure 181 and does not substantially intrude into either the region thereof occupied by explosive 185 or the region occupied by void 186, thereby providing the void and establishing the safe condition of device 170. However when the explosive is liquified, the expansible element is, when pressurized, free to expand by an increase in volume substantially equal to the volume of void 186 thereby urging the explosive liquid, as shown in FIG. 9, to occupy a peripheral region 192 of enclosure 181, region 192 extending between detonator 182 and lead 183 to establish the armed condition of device 170.

It is apparent that a rocket having a device such as device 170 cannot establish an armed condition until the motor portion of the rocket has burned for a long enough time to melt explosive 185 at the same time the motor portion is generating pressurized gas.

Sixth Embodiment

Figure 10:
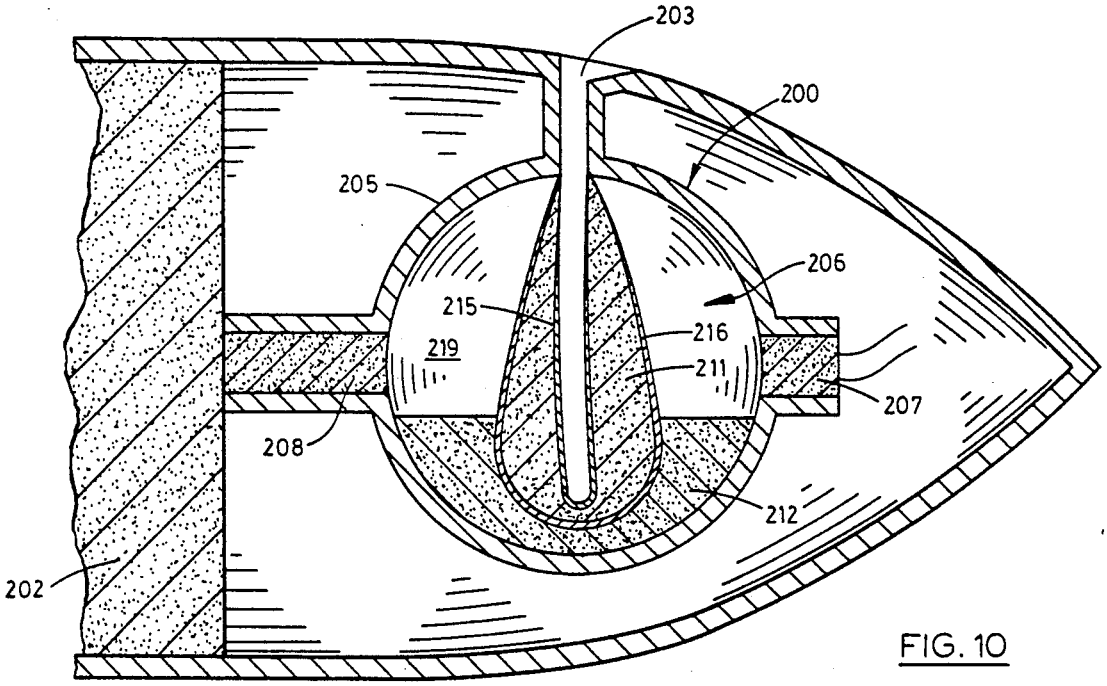
FIG. 10 is a diagram of a sixth safe and arm device which embodies the present invention and which is characterized by the use of a binary explosive, the FIG. 10 device being shown in a safe condition and in a fourth representative operating environment.
Figure 11:
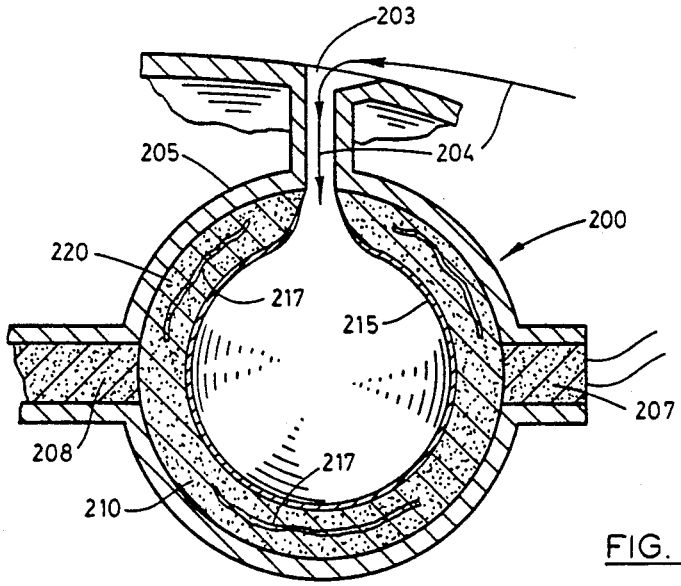
FIG. 11 is a diagram showing the FIG. 10 device in an armed condition.

A sixth safe and arm device 200 embodying the present invention is shown in FIGS. 10 and 11 in a representative operating environment which is the forward portion of a projectile having an explosive charge 202, parts of the projectile being omitted in FIG. 11. The projectile has an orifice 203 disposed to admit fluid under pressure as indicated in FIG. 11 by arrow 204, this pressure being generated by the velocity of the projectile through air or other medium. Device 200 has a generally spherical wall 205 which defines an enclosure 206 in fluid pressure communication with orifice 203. A detonator 207, which corresponds to FIG. 1 detonator 32, is disposed at one side of the enclosure and an explosive lead 208, which corresponds to lead 35, extends from the enclosure to charge 202. The enclosure is thus a portion of an explosive train including the detonator and the lead.

Device 200 is characterized by the use of a liquid and binary explosive indicated by numeral 210 in FIG. 11 and corresponding generally to explosive 22. Explosive 210 is formed by the mixing of a predetermined quantity of a first precursor liquid and a predetermined quantity of a second precursor liquid, these precursor liquids being indicated in FIG. 10 by respective numerals 211 and 212. Such binary explosives are well-known and are advantageous in that the precursor liquids are relatively inert and do not explode in the above defined sense of decomposition in a shock wave. Liquids 211 and 212 thus attenuate rather than amplify a detonation wave.

Device 200 has a first or inner bladder-like expansible element 215, which is similar to element 190, disposed within enclosure 206 and communicating with orifice 203 to receive fluid pressure 204. This pressure urges element 215 to expand from a contracted condition, in which the element is depicted in FIG. 10, into an expanded condition depicted in FIG. 11. Device 200 has a second or outer bladder-like expansible and also rupturable element 216 disposed within enclosure 206 and surrounding element 215. Element 216 is similar to element 215 in having a contracted condition in which the element is depicted in FIG. 10. However when element 216 is expanded substantially from its contracted condition by internal pressure as subsequently described, element 216 ruptures as indicated by fragments 217 thereof in FIG. 11.

In a safe condition of device 200 shown in FIG. 10, inner expansible element 215 is contracted so as to have substantially no internal volume; first precursor liquid 211 is stored within enclosure 206 between element 215 and outer expansible element 216; and second precursor liquid 212 is stored within enclosure 206 outwardly of element 215 between element 215 and wall 205. The relative volumes of enclosure 206, of liquids 211 and 212, and of outer expansible element 216 in its contracted condition are selected so that the first liquid 211 occupies substantially all of the volume between elements 215 and 216 while the second liquid 212 occupies only a portion of the volume between element 215 and wall 205 so that a void 219 exists within enclosure 206 and element 216 at a region of the enclosure between detonator 207 and lead 208. Void 219, together with the non-explosive nature of liquids 211 and 212, establishes the safe condition of device 200. However, inner expansible element 215 is, when pressurized through orifice 203, free to expand to its FIG. 11 expanded condition by an increase in volume substantially equal to the volume of void 219 thereby urging the first precursor liquid 211 to rupture outer expansible element 216 and mix with second precursor liquid 212 so as to form the binary explosive liquid 211. Subsequent expansion of the first element by the flow indicated by arrows 204 urges inner element 215 to expand until the volume of void 219 is substantially filled by the explosive liquid which then occupies a peripheral region 220 of enclosure 206. Region 220 extends between detonator 207 and lead 208 and thus establishes the armed condition of device 200 when there exists the environmental condition of the FIG. 10 projectile attaining a sufficient velocity to expand element 215 and rupture element 216.

In a device of the present invention having, as shown in FIGS. 9 and 10, an enclosure 181 or 206 with an associated detonator 182 or 207 and explosive lead 183 or 208, it is desirable that the lead and detonator be disposed oppositely of the enclosure as depicted in FIG. 10 so that a liquid explosive, such as 210, or a solid explosive to be liquified cannot extend between the detonator and the lead in any orientation of the enclosure prior to the event, such as pressurization of bladder 190, that is intended to establish the armed condition of the device.

It is evident that a device of the present invention, which forms from non-explosive precursor liquids a binary explosive liquid such as explosive 210, may utilize the binary explosive liquid in a manometerlike device such as those shown in FIGS. 1-5.

Obviously, many modifications and variations of the present invention are possible in light of the above teachings. It is, therefore, to be understood that the invention may be practiced within the scope of the following claims other than as specifically described herein.

What is claimed is:

1. A safe and arm device comprising:

an explosive train having a predetermined region, said region being substantially void to establish a safe condition of said train by interrupting progress of an explosion along the train;

a quantity of a substance having a solid state liquefiable to provide an explosive liquid, said substance being in said solid state;

storage means spaced from said predetermined region for storing said quantity;

liquefying means for liquefying said quantity of said substance in said solid state into said explosive liquid; and conduit means for conducting said explosive liquid into said predetermined region after liquefaction of said substance in said solid state by said liquifying means, said liquid in said region establishing an armed condition of said train.

2. The safe and arm device of claim 1 wherein said liquefying means comprises an electric heater for said quantity of said substance in said solid state.

3. The safe and arm device of claim 1 wherein said solid state of said substance is a solid phase of said substance and said explosive liquid is said substance in a liquid phase thereof formed by melting said solid phase.

4. The safe and arm device of claim 3 wherein said substance is trinitrotoluene.

5. A safe and arm device for use with a vehicle for travel in a fluid at a velocity providing a pressure differential in said fluid, the device comprising:

an explosive train having a predetermined region, said region being substantially void to establish a safe condition of said train by interrupting progress of an explosion along the train;

an explosive liquid;

storage means spaced from said predetermined region for storing said explosive liquid;

conduit means for conducting said explosive liquid into said predetermined region to establish an armed condition of said train; and means for providing said pressure differential to said storage means and said predetermined region so as to urge said explosive liquid from said storage means into said predetermined region.

6. A safe and arm device for use in a vehicle providing a pressurized fluid when an armed condition of the device is to be established, the device comprising:

an explosive train having a predetermined region, said region being substantially void to establish a safe condition of said train by interrupting progress of an explosion along said train;

an explosive liquid;

a manometer containing said predetermined region and said explosive liquid, said predetermined region being at a predetermined location in said manometer when the device is in said safe condition, and said predetermined location being included in said explosive train; and means for applying said pressurized fluid to said manometer and to said explosive liquid to urge said explosive liquid to flow into said predetermined region to establish said armed condition.

7. A safe and arm device for use in an apparatus:

for travel through a fluid medium so as to generate a fluid pressure in said medium, and having an explosive train for propagating an explosive detonation wave, the device comprising:

a wall defining an enclosure having a predetermined region interposed in said train, said region being substantially void so as to block propagation of said detonation wave through said enclosure;

a quantity of an explosive disposed in said enclosure, said explosive;

having a predetermined melting temperature, being at a temperature below said melting temperature and in a solid phase, and being disposed outside of said region;

means for heating said wall so as to heat said explosive to a temperature above said melting temperature and melt said explosive into a liquid phase; and means for providing said fluid pressure to said enclosure so that said fluid pressure urges said explosive in said liquid phase to flow into said region so that said detonation wave detonates said explosive and said explosive propagates said detonation wave through said enclosure.

* * * * *

UNITED STATES PATENT AND TRADEMARK OFFICE

CERTIFICATE OF CORRECTION

PATENT NO. : 5,212,340

DATED : May 18,1993

INVENTOR(S) : Lee R. Hardt

It is certified that error appears in the above-indentified patent and that said Letters Patent is hereby corrected as shown below:

On the title page: Item [75]

At "Inventors" delete "Donald R. Burnett, Both"

Signed and Sealed this

Twelfth Day of April, 1994

Bruce Lehman

*Attest:*

BRUCE LEHMAN

*Commissioner of Patents and Trademarks*

*Attesting Officer*